US010366654B2

(12) United States Patent
Chang et al.

(10) Patent No.: US 10,366,654 B2
(45) Date of Patent: Jul. 30, 2019

(54) OLED PIXEL CIRCUIT AND METHOD FOR RETARDING AGING OF OLED DEVICE

(71) Applicant: Shenzhen China Star Optoelectronics Semiconductor Display Technology Co., Ltd., Shenzhen (CN)

(72) Inventors: Bobiao Chang, Shenzhen (CN); Xiaolong Chen, Shenzhen (CN); Yi-chien Wen, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 15/572,505

(22) PCT Filed: Oct. 26, 2017

(86) PCT No.: PCT/CN2017/107820
§ 371 (c)(1),
(2) Date: Nov. 8, 2017

(87) PCT Pub. No.: WO2019/037232
PCT Pub. Date: Feb. 28, 2019

(65) Prior Publication Data

US 2019/0066583 A1 Feb. 28, 2019

(30) Foreign Application Priority Data

Aug. 24, 2017 (CN) ..... 2017 1 0734275

(51) Int. Cl.
*G09G 3/30* (2006.01)
*G09G 3/3258* (2016.01)
(Continued)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/323225; G09G 3/3225; G09G 3/3258
(Continued)

(56) References Cited

U.S. PATENT DOCUMENTS

2004/0056605 A1* 3/2004 Yoshida ..... G09G 3/3233 315/169.3
2004/0090186 A1* 5/2004 Yoshida ..... G09G 3/3233 315/169.1
(Continued)

FOREIGN PATENT DOCUMENTS

CN 101154343 4/2008
CN 203502926 3/2014
(Continued)

*Primary Examiner* — Adam J Snyder

(57) ABSTRACT

The present disclosure provides an OLED pixel circuit and a method for retarding the aging of an OLED device. By providing a first sub-pixel driving unit, a second sub-pixel driving unit, a first reverse biasing unit, and a second reverse biasing unit and by simple control timing, a first light emitting diode and a second light emitting diode will not always be in a DC biased state, and the first light emitting diode and the second light emitting diode will emit light alternately in different frames.

9 Claims, 4 Drawing Sheets

(51) Int. Cl.
*G09G 3/3233* (2016.01)
*G09G 3/10* (2006.01)

(52) U.S. Cl.
CPC ..... *G09G 2300/0861* (2013.01); *G09G 2310/0262* (2013.01); *G09G 2310/08* (2013.01); *G09G 2320/045* (2013.01)

(58) Field of Classification Search
USPC ..... 345/76; 315/169.3
See application file for complete search history.

(56) References Cited

U.S. PATENT DOCUMENTS

| | | | | |
|---|---|---|---|---|
| 2014/0375616 | A1 | 12/2014 | Kim et al. | |
| 2015/0116191 | A1* | 4/2015 | Qi | G09G 3/3233 345/76 |
| 2015/0325169 | A1* | 11/2015 | Qing | G09G 3/3225 345/214 |
| 2016/0125803 | A1* | 5/2016 | Qing | G09G 3/3233 345/209 |
| 2016/0224157 | A1 | 8/2016 | Yang | |
| 2017/0032759 | A1 | 2/2017 | Hwang et al. | |
| 2018/0158839 | A1 | 6/2018 | Umezaki et al. | |
| 2018/0226019 | A1* | 8/2018 | Tong | G09G 3/3233 |
| 2018/0269232 | A1 | 9/2018 | Cai | |

FOREIGN PATENT DOCUMENTS

| | | |
|---|---|---|
| CN | 104091559 | 10/2014 |
| CN | 106297672 | 1/2017 |
| CN | 106782340 | 5/2017 |
| CN | 107068060 | 8/2017 |

* cited by examiner

OLED PIXEL CIRCUIT AND METHOD FOR RETARDING AGING OF OLED DEVICE

RELATED APPLICATIONS

This application is a National Phase of PCT Patent Application No. PCT/CN2017/107820 having International filing date of Oct. 26, 2017, which claims the benefit of priority of Chinese Patent Application No. 201710734275.1 filed on Aug. 24, 2017. The contents of the above applications are all incorporated by reference as if fully set forth herein in their entirety.

FIELD AND BACKGROUND OF THE INVENTION

The present disclosure relates to the technical field of display technology, and more particularly to an OLED pixel circuit and a method for retarding the aging of an OLED device.

An Active Matrix Organic Light Emitting Diode (AMOLED) is able to emit light because it is driven by current generated by a driving Thin Film Transistor (TFT) in a saturated state, and a conventional AMOLED pixel circuit is generally a 2T1C driving circuit. Referring to FIG. 1, the 2T1C circuit includes two TFTs and one capacitor, wherein T1 is a driving transistor of the pixel circuit, and T2 is a switching transistor; the switching transistor T2 is turned on by a scanning line Gate, the storage capacitor Cst is charged by a data voltage Vdata, and the switching transistor T2 is turned off during the light emission; and, the voltage stored in the capacitor keeps the driving transistor T1 turned on, and the turn-on current enables a Light Emitting Diode (OLED) to emit light. Since the OLED is in a DC biased state for a long period of time, ions inside the OLED are polarized to form a built-in electric field, so that the threshold voltage of the OLED increases constantly, the luminance of the OLED decreases constantly, and the service life of the OLED is thus shortened. In addition, since the DC biased voltage of the OLED is different in different gray levels, the degree of aging of the OLED in each sub-pixel is also different. Consequently, pictures displayed on the screen are not uniform, and the display effect is influenced.

In view of the problems in the 2T1C driving circuit, further improvements are made to the prior art to solve the problem that an OLED is in a DC biased state for a long period of time. However, many voltage control lines are generally required in an improved circuit, the control timing is relatively complicated, and the cost is greatly increased.

Thus, it is necessary to provide an OLED pixel circuit and a method for retarding the aging of an OLED device to overcome the problems existing in the conventional technology.

SUMMARY OF THE INVENTION

An objective of the present disclosure is to provide an OLED pixel circuit and a method for retarding the aging of an OLED device in order to solve the problem that a light emitting diode in an existing OLED pixel circuit is in a DC biased state for a long period of time and thus prone to aging.

For this purpose, the OLED pixel circuit provided by the present disclosure adopts the following technical solution:

An OLED pixel circuit, comprising:

a first sub-pixel driving unit, comprising a first thin-film transistor, a fifth thin-film transistor, a first capacitor, and a first light emitting diode;

a second sub-pixel driving unit, comprising a second thin-film transistor, a sixth thin-film transistor, a second capacitor, and a second light emitting diode, wherein:

both a source of the first thin-film transistor and a source of the second thin-film transistor are connected to a positive supply voltage; a gate of the first thin-film transistor is electrically connected to a first node, and a gate of the second thin-film transistor is electrically connected to a second node; and, a drain of the first thin-film transistor is electrically connected to an anode of the first light emitting diode, and a drain of the second thin-film transistor is electrically connected to an anode of the second light emitting diode;

a data signal is fed into both a source of the fifth thin-film transistor and a source of the sixth thin-film transistor; a drain of the fifth thin-film transistor is electrically connected to the first node, and a drain of the sixth thin-film transistor is electrically connected to the second node; and, a second control signal is fed into a gate of the fifth thin-film transistor, and a third control signal is fed into a gate of the sixth thin-film transistor; and one end of the first capacitor is electrically connected to the first node, while the other end thereof is connected to the positive supply voltage; and, one end of the second capacitor is electrically connected to the second node, while the other end thereof is connected to the positive supply voltage;

a first reverse biasing unit, comprising a third thin-film transistor, a seventh thin-film transistor, and a ninth thin-film transistor; and a second reverse biasing unit, comprising a fourth thin-film transistor, an eighth thin-film transistor, and a tenth thin-film transistor, wherein:

a first control signal is fed into both a gate of the third thin-film transistor and a gate of the fourth thin-film transistor; both a source of the third thin-film transistor and a source of the fourth thin-film transistor are connected to the positive supply voltage; and, a drain of the third thin-film transistor is electrically connected to a cathode of the first light emitting diode, and a drain of the fourth thin-film transistor is electrically connected to a cathode of the second light emitting diode;

the first control signal is fed into both a gate of the seventh thin-film transistor and a gate of the eighth thin-film transistor; a drain of the seventh thin-film transistor is electrically connected to an anode terminal of the first light emitting diode, and a drain of the eighth thin-film transistor is electrically connected to an anode terminal of the second light emitting diode; and, both a source of the seventh thin-film transistor and a source of the eighth thin-film transistor are connected to a negative supply voltage;

the first control signal is fed into both a gate of the ninth thin-film transistor and a gate of the tenth thin-film transistor; both a source of the ninth thin-film transistor and a source of the tenth thin-film transistor are connected to the negative supply voltage; and, a drain of the ninth thin-film transistor is electrically connected to the cathode of the first light emitting diode, and a drain of the tenth thin-film transistor is electrically connected to the cathode of the second light emitting diode;

the first control signal, the second control signal, and the third control signal are all provided by an external timing controller;

the first thin-film transistor, the second thin-film transistor, the third thin-film transistor, the fourth thin-film transistor, the fifth thin-film transistor, the sixth thin-film transistor, the seventh thin-film transistor, the eighth thin-film transistor, the ninth thin-film transistor, and the tenth thin-film transistor are all low temperature polysilicon thin-film transistors, oxide semiconductor thin-film transistors or amorphous silicon thin-film transistors.

In the OLED pixel circuit of the present disclosure, the first control signal, the second control signal, and the third control signal are combined to sequentially correspond to a potential storage stage of the first light emitting diode, a luminescent display stage of the first light emitting diode, a potential storage stage of the second light emitting diode, and a luminescent display stage of the second light emitting diode.

In the OLED pixel circuit of the present disclosure, the first thin-film transistor, the second thin-film transistor, the third thin-film transistor, the fifth thin-film transistor, the sixth thin-film transistor, the seventh thin-film transistor, and the tenth thin-film transistor are all N-type thin-film transistors; the fourth thin-film transistor, the eighth thin-film transistor, and the ninth thin-film transistor are all P-type thin-film transistors;

in the potential storage stage of the first light emitting diode, the first control signal provides a low potential, the second control signal provides a high potential, and the third control signal provides a low potential;

in the luminescent display stage of the first light emitting diode, the first control signal provides a low potential, the second control signal provides a low potential, and the third control signal provides a low potential;

in the potential storage stage of the second light emitting diode, the first control signal provides a high potential, the second control signal provides a low potential, and the third control signal provides a high potential; and in the luminescent display stage of the second light emitting diode, the first control signal provides a high potential, the second control signal provides a low potential, and the third control signal provides a low potential.

The OLED pixel circuit provided by the present disclosure further adopts the following technical solution:

An OLED pixel circuit, comprising:

a first sub-pixel driving unit, comprising a first thin-film transistor, a fifth thin-film transistor, a first capacitor, and a first light emitting diode;

a second sub-pixel driving unit, comprising a second thin-film transistor, a sixth thin-film transistor, a second capacitor, and a second light emitting diode, wherein:

both a source of the first thin-film transistor and a source of the second thin-film transistor are connected to a positive supply voltage; a gate of the first thin-film transistor is electrically connected to a first node, and a gate of the second thin-film transistor is electrically connected to a second node; and, a drain of the first thin-film transistor is electrically connected to an anode of the first light emitting diode, and a drain of the second thin-film transistor is electrically connected to an anode of the second light emitting diode;

a data signal is fed into both a source of the fifth thin-film transistor and a source of the sixth thin-film transistor; a drain of the fifth thin-film transistor is electrically connected to the first node, and a drain of the sixth thin-film transistor is electrically connected to the second node; and, a second control signal is fed into a gate of the fifth thin-film transistor, and a third control signal is fed into a gate of the sixth thin-film transistor; and one end of the first capacitor is electrically connected to the first node, while the other end thereof is connected to the positive supply voltage; and, one end of the second capacitor is electrically connected to the second node, while the other end thereof is connected to the positive supply voltage;

a first reverse biasing unit, comprising a third thin-film transistor, a seventh thin-film transistor, and a ninth thin-film transistor; and a second reverse biasing unit, comprising a fourth thin-film transistor, an eighth thin-film transistor, and a tenth thin-film transistor, wherein:

a first control signal is fed into both a gate of the third thin-film transistor and a gate of the fourth thin-film transistor; both a source of the third thin-film transistor and a source of the fourth thin-film transistor are connected to the positive supply voltage; and, a drain of the third thin-film transistor is electrically connected to a cathode of the first light emitting diode, and a drain of the fourth thin-film transistor is electrically connected to a cathode of the second light emitting diode;

the first control signal is fed into both a gate of the seventh thin-film transistor and a gate of the eighth thin-film transistor; a drain of the seventh thin-film transistor is electrically connected to an anode terminal of the first light emitting diode, and a drain of the eighth thin-film transistor is electrically connected to an anode terminal of the second light emitting diode; and, both a source of the seventh thin-film transistor and a source of the eighth thin-film transistor are connected to a negative supply voltage;

the first control signal is fed into both a gate of the ninth thin-film transistor and a gate of the tenth thin-film transistor; both a source of the ninth thin-film transistor and a source of the tenth thin-film transistor are connected to the negative supply voltage; and, a drain of the ninth thin-film transistor is electrically connected to the cathode of the first light emitting diode, and a drain of the tenth thin-film transistor is electrically connected to the cathode of the second light emitting diode.

In the OLED pixel circuit of the present disclosure, the first control signal, the second control signal, and the third control signal are all provided by an external timing controller.

In the OLED pixel circuit of the present disclosure, the first thin-film transistor, the second thin-film transistor, the third thin-film transistor, the fourth thin-film transistor, the fifth thin-film transistor, the sixth thin-film transistor, the seventh thin-film transistor, the eighth thin-film transistor, the ninth thin-film transistor, and the tenth thin-film transistor are all low temperature polysilicon thin-film transistors, oxide semiconductor thin-film transistors, or amorphous silicon thin-film transistors.

In the OLED pixel circuit of the present disclosure, the first control signal, the second control signal, and the third control signal are combined to sequentially correspond to a potential storage stage of the first light emitting diode, a luminescent display stage of the first light emitting diode, a potential storage stage of the second light emitting diode and a luminescent display stage of the second light emitting diode.

In the OLED pixel circuit of the present disclosure, the first thin-film transistor, the second thin-film transistor, the third thin-film transistor, the fifth thin-film transistor, the sixth thin-film transistor, the seventh thin-film transistor, and the tenth thin-film transistor are all N-type thin-film transistors; the fourth thin-film transistor, the eighth thin-film transistor, and the ninth thin-film transistor are all P-type thin-film transistors;

in the potential storage stage of the first light emitting diode, the first control signal provides a low potential, the second control signal provides a high potential, and the third control signal provides a low potential;

in the luminescent display stage of the first light emitting diode, the first control signal provides a low potential, the second control signal provides a low potential, and the third control signal provides a low potential;

in the potential storage stage of the second light emitting diode, the first control signal provides a high potential, the second control signal provides a low potential, and the third control signal provides a high potential; and in the luminescent display stage of the second light emitting diode, the first control signal provides a high potential, the second control signal provides a low potential, and the third control signal provides a low potential.

The present disclosure further provides a method for retarding aging of an OLED device. The method comprises the following steps:

step 1: providing an OLED pixel circuit; wherein the OLED pixel circuit includes:

a first sub-pixel driving unit, comprising a first thin-film transistor, a fifth thin-film transistor, a first capacitor, and a first light emitting diode;

a second sub-pixel driving unit, comprising a second thin-film transistor, a sixth thin-film transistor, a second capacitor, and a second light emitting diode, wherein:

both a source of the first thin-film transistor and a source of the second thin-film transistor are connected to a positive supply voltage; a gate of the first thin-film transistor is electrically connected to a first node, and a gate of the second thin-film transistor is electrically connected to a second node; and, a drain of the first thin-film transistor is electrically connected to an anode of the first light emitting diode, and a drain of the second thin-film transistor is electrically connected to an anode of the second light emitting diode;

a data signal is fed into both a source of the fifth thin-film transistor and a source of the sixth thin-film transistor; a drain of the fifth thin-film transistor is electrically connected to the first node, and a drain of the sixth thin-film transistor is electrically connected to the second node; and, a second control signal is fed into a gate of the fifth thin-film transistor, and a third control signal is fed into a gate of the sixth thin-film transistor; and one end of the first capacitor is electrically connected to the first node, while the other end thereof is connected to the positive supply voltage; and, one end of the second capacitor is electrically connected to the second node, while the other end thereof is connected to the positive supply voltage;

a first reverse biasing unit, comprising a third thin-film transistor, a seventh thin-film transistor, and a ninth thin-film transistor; and a second reverse biasing unit, comprising a fourth thin-film transistor, an eighth thin-film transistor, and a tenth thin-film transistor, wherein:

a first control signal is fed into both a gate of the third thin-film transistor and a gate of the fourth thin-film transistor; both a source of the third thin-film transistor and a source of the fourth thin-film transistor are connected to the positive supply voltage; and, a drain of the third thin-film transistor is electrically connected to a cathode of the first light emitting diode, and a drain of the fourth thin-film transistor is electrically connected to a cathode of the second light emitting diode;

the first control signal is fed into both a gate of the seventh thin-film transistor and a gate of the eighth thin-film transistor; a drain of the seventh thin-film transistor is electrically connected to an anode terminal of the first light emitting diode, and a drain of the eighth thin-film transistor is electrically connected to an anode terminal of the second light emitting diode; and, both a source of the seventh thin-film transistor and a source of the eighth thin-film transistor are connected to a negative supply voltage;

the first control signal is fed into both a gate of the ninth thin-film transistor and a gate of the tenth thin-film transistor; both a source of the ninth thin-film transistor and a source of the tenth thin-film transistor are connected to the negative supply voltage; and, a drain of the ninth thin-film transistor is electrically connected to the cathode of the first light emitting diode, and a drain of the tenth thin-film transistor is electrically connected to the cathode of the second light emitting diode;

step 2: entering a potential storage stage of the first light emitting diode, the potential storage stage of the first light emitting diode being in an Nth frame;

controlling, by the first control signal, the second control signal, and the third control signal, to turn on the fourth thin-film transistor, the fifth thin-film transistor, the eighth thin-film transistor, and the ninth thin-film transistor and to turn off the first thin-film transistor, the second thin-film transistor, the third thin-film transistor, the sixth thin-film transistor, the seventh thin-film transistor, and the tenth thin-film transistor, storing a potential of a data signal by the first capacitor, and bringing the second light emitting diode into a reversely biased state;

step 3: entering a luminescent display stage of the first light emitting diode, the luminescent display stage of the first light emitting diode being in an Nth frame;

controlling, by the first control signal, the second control signal, and the third control signal, to turn on the first thin-film transistor, the fourth thin-film transistor, the eighth thin-film transistor, and the ninth thin-film transistor and to turn off the second thin-film transistor, the third thin-film transistor, the fifth thin-film transistor, the sixth thin-film transistor, the seventh thin-film transistor, and the tenth thin-film transistor, emitting light by the first light emitting diode, and keeping the second light emitting diode in the reversely biased state;

step 4: entering a potential storage stage of the second light emitting diode, the potential storage stage of the second light emitting diode being in an (N+1)th frame;

controlling, by the first control signal, the second control signal, and the third control signal, to turn on the first thin-film transistor, the second thin-film transistor, the third thin-film transistor, the sixth thin-film transistor, the seventh thin-film transistor, and the ninth thin-film transistor and to turn off the fourth thin-film transistor, the fifth thin-film transistor, the eighth thin-film transistor, and the tenth thin-film transistor, storing a potential of a data signal by the second capacitor, and bringing the first light emitting diode into the reversely biased state; and step 5: entering a luminescent display stage of the second light emitting diode, the luminescent display stage of the second light emitting diode being in an (N+1)th frame;

controlling, by the first control signal, the second control signal, and the third control signal, to turn on the second thin-film transistor, the third thin-film transistor, the seventh thin-film transistor, and the tenth thin-film transistor and to turn off the first thin-film transistor, the fourth thin-film transistor, the fifth thin-film transistor, the sixth thin-film transistor, the eighth thin-film transistor, and the ninth thin-film transistor, emitting light by the second light emitting diode, and keeping the first light emitting diode in the reversely biased state.

In the method for retarding aging of an OLED device of the present disclosure, the first control signal, the second control signal, and the third control signal are all provided by an external timing controller.

In the method for retarding aging of an OLED device of the present disclosure, the first thin-film transistor, the second thin-film transistor, the third thin-film transistor, the fourth thin-film transistor, the fifth thin-film transistor, the sixth thin-film transistor, the seventh thin-film transistor, the eighth thin-film transistor, the ninth thin-film transistor, and the tenth thin-film transistor are all low temperature polysilicon thin-film transistors, oxide semiconductor thin-film transistors, or amorphous silicon thin-film transistors.

In the method for retarding aging of an OLED device of the present disclosure, the first thin-film transistor, the second thin-film transistor, the third thin-film transistor, the fifth thin-film transistor, the sixth thin-film transistor, the seventh thin-film transistor, and the tenth thin-film transistor are all N-type thin-film transistors; the fourth thin-film transistor, the eighth thin-film transistor, and the ninth thin-film transistor are all P-type thin-film transistors;

in the potential storage stage of the first light emitting diode, the first control signal provides a low potential, the second control signal provides a high potential, and the third control signal provides a low potential;

in the luminescent display stage of the first light emitting diode, the first control signal provides a low potential, the second control signal provides a low potential, and the third control signal provides a low potential;

in the potential storage stage of the second light emitting diode, the first control signal provides a high potential, the second control signal provides a low potential, and the third control signal provides a high potential; and in the luminescent display stage of the second light emitting diode, the first control signal provides a high potential, the second control signal provides a low potential, and the third control signal provides a low potential.

In the OLED pixel circuit and the method for retarding the aging of an OLED device of the present disclosure, by providing a first sub-pixel driving unit, a second sub-pixel driving unit, a first reverse biasing unit, and a second reverse biasing unit and by simple control timing, a first light emitting diode and a second light emitting diode will not always be in a DC biased state, and the first light emitting diode and the second light emitting diode will emit light alternately in different frames. Accordingly, the luminescence time of the first light emitting diode and the second light emitting diode is reduced, the aging of the first light emitting diode and the second light emitting diode is retarded, and the display quality of a panel is improved.

To make the contents of the present disclosure more apparent and understandable, the present disclosure will be described below in detail by preferred embodiments with reference to the accompanying drawings.

BRIEF DESCRIPTION OF THE SEVERAL VIEWS OF THE DRAWINGS

The technical solution, as well as beneficial advantages, of the present disclosure will be apparent from the following detailed description of the specific embodiments of the present disclosure, with reference to the accompanying drawings.

DESCRIPTION OF SPECIFIC EMBODIMENTS OF THE INVENTION

For better explaining the technical solution and the effect of the present disclosure, the present disclosure will be further described in detail with the accompanying drawings and the specific embodiments. The described embodiments are some but not all of the embodiments of the present disclosure. All other embodiments obtained by a person of ordinary skill in the art based on the embodiments of the present disclosure without creative efforts shall fall within the protection scope of the present disclosure.

Figure 1:
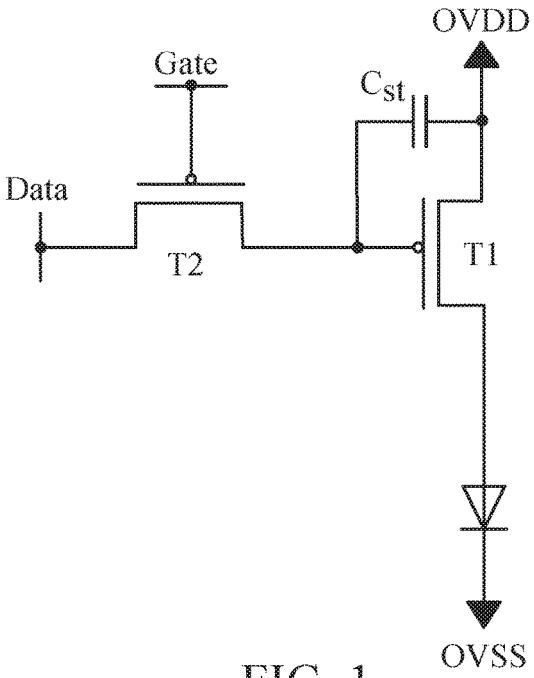
FIG. 1 PRIOR ART
FIG. 1 is a circuit diagram of a conventional OLED pixel circuit in a 2T1C structure.
Figure 2:
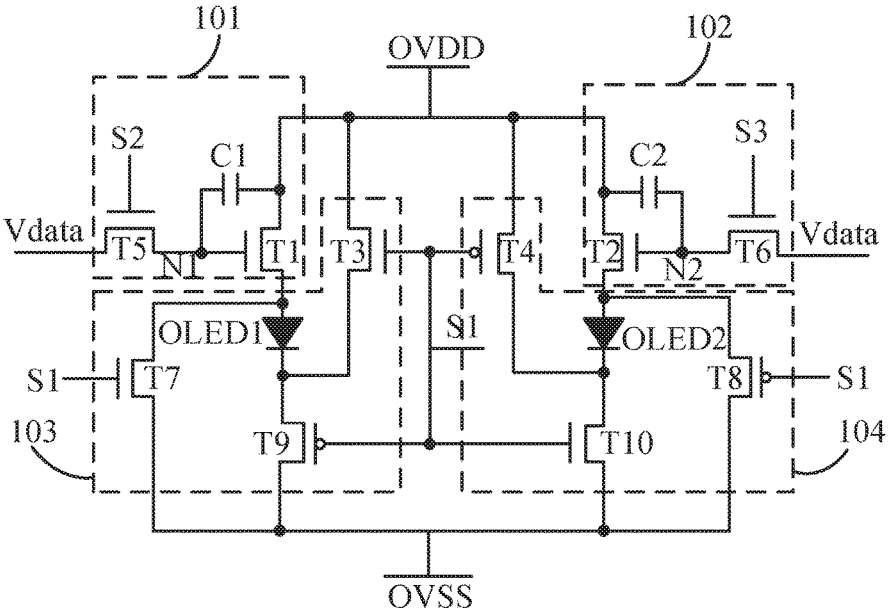
FIG. 2 is a circuit diagram of an OLED pixel circuit according to the present disclosure.

Referring to FIG. 2, the present disclosure provides an OLED pixel circuit, including a first sub-pixel driving unit 101, a second sub-pixel driving unit 102, a first reverse biasing unit 103, and a second reverse biasing unit 104, wherein the first sub-pixel driving unit 101 includes a first thin-film transistor T1, a fifth thin-film transistor T5, a first capacitor C1, and a first light emitting diode OLED1; the second sub-pixel driving unit 102 includes a second thin-film transistor T2, a sixth thin-film transistor T6, a second capacitor C2, and a second light emitting diode OLED2; the first reverse biasing unit 103 includes a third thin-film transistor T3, a seventh thin-film transistor T7, and a ninth thin-film transistor T9; and, the second reverse biasing unit 104 includes a fourth thin-film transistor T4, an eighth thin-film transistor T8, and a tenth thin-film transistor T10.

Further, both a source of the first thin-film transistor T1 and a source of the second thin-film transistor T2 are connected to a positive supply voltage OVDD; a gate of the first thin-film transistor T1 is electrically connected to a first node N1, and a gate of the second thin-film transistor T2 is electrically connected to a second node N2; and, a drain of the first thin-film transistor T1 is electrically connected to an anode of the first light emitting diode OLED1, and a drain of the second thin-film transistor T2 is electrically connected to an anode of the second light emitting diode OLED2.

A data signal Vdata is fed into both a source of the fifth thin-film transistor T5 and a source of the sixth thin-film transistor T6; a drain of the fifth thin-film transistor T5 is electrically connected to the first node N1, and a drain of the sixth thin-film transistor T6 is electrically connected to the second node N2; and, a second control signal S2 is fed into a gate of the fifth thin-film transistor T5, and a third control signal S3 is fed into a gate of the sixth thin-film transistor T6.

One end of the first capacitor C1 is electrically connected to the first node N1, while the other end thereof is connected to the positive supply voltage OVDD; and, one end of the second capacitor C2 is electrically connected to the second node N2, while the other end thereof is connected to the positive supply voltage OVDD.

A first control signal S1 is fed into both a gate of the third thin-film transistor T3 and a gate of the fourth thin-film transistor T4; both a source of the third thin-film transistor T3 and a source of the fourth thin-film transistor T4 are connected to the positive supply voltage OVDD; and, a drain of the third thin-film transistor T3 is electrically connected to a cathode of the first light emitting diode OLED1, and a drain of the fourth thin-film transistor T4 is electrically connected to the cathode of the second light emitting diode OLED2.

The first control signal S1 is fed into both a gate of the seventh thin-film transistor T7 and a gate of the eighth thin-film transistor T8; a drain of the seventh thin-film transistor T7 is electrically connected to an anode terminal of the first light emitting diode OLED1, and a drain of the eighth thin-film transistor T8 is electrically connected to an anode terminal of the second light emitting diode OLED2; and, both a source of the seventh thin-film transistor T7 and a source of the eighth thin-film transistor T8 are connected to a negative supply voltage OVSS.

The first control signal S1 is fed into both a gate of the ninth thin-film transistor T9 and a gate of the tenth thin-film transistor T10; both a source of the ninth thin-film transistor T9 and a source of the tenth thin-film transistor T10 are connected to the negative supply voltage OVSS; and, a drain of the ninth thin-film transistor T9 is electrically connected to the cathode of the first light emitting diode OLED1, and a drain of the tenth thin-film transistor T10 is electrically connected to the cathode of the second light emitting diode OLED2.

Specifically, the first thin-film transistor T1, the second thin-film transistor T2, the third thin-film transistor T3, the fourth thin-film transistor T4, the fifth thin-film transistor T5, the sixth thin-film transistor T6, the seventh thin-film transistor T7, the eighth thin-film transistor T8, the ninth thin-film transistor T9, and the tenth thin-film transistor T10 are all low temperature polysilicon thin-film transistors, oxide semiconductor thin-film transistors, or amorphous silicon thin-film transistors. Furthermore, the first thin-film transistor T1, the second thin-film transistor T2, the third thin-film transistor T3, the fifth thin-film transistor T5, the sixth thin-film transistor T6, the seventh thin-film transistor T7, and the tenth thin-film transistor T10 are all N-type thin-film transistors; the fourth thin-film transistor T4, the eighth thin-film transistor T8, and the ninth thin-film transistor T9 are all P-type thin-film transistors.

Specifically, the first control signal S1, the second control signal S2, and the third control signal S3 are all provided by an external timing controller.

Figure 3:
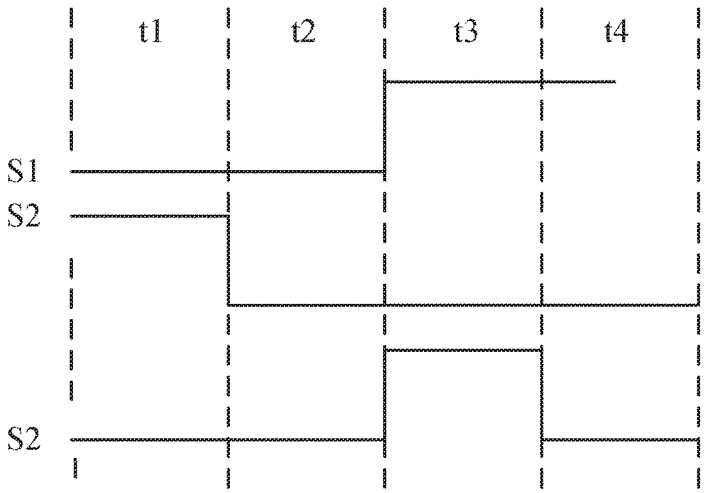
FIG. 3 is a timing diagram of the OLED pixel circuit according to the present disclosure.

FIG. 3 is a timing diagram of the control signals in the OLED pixel circuit according to an embodiment of the present disclosure. Referring to FIGS. 2 and 3, in this embodiment, the first control signal S1, the second control signal S2 and the third control signal S3 are combined to sequentially correspond to a potential storage stage t1 of the first light emitting diode, a luminescent display stage t2 of the first light emitting diode, a potential storage stage t3 of the second light emitting diode, and a luminescent display stage t4 of the second light emitting diode. Both the potential storage stage t1 of the first light emitting diode and the luminescent display stage t2 of the first light emitting diode are in an Nth frame; and both the potential storage stage t3 of the second light emitting diode and the luminescent display stage t4 of the second light emitting diode are in an (N+1)th frame.

Figure 4:
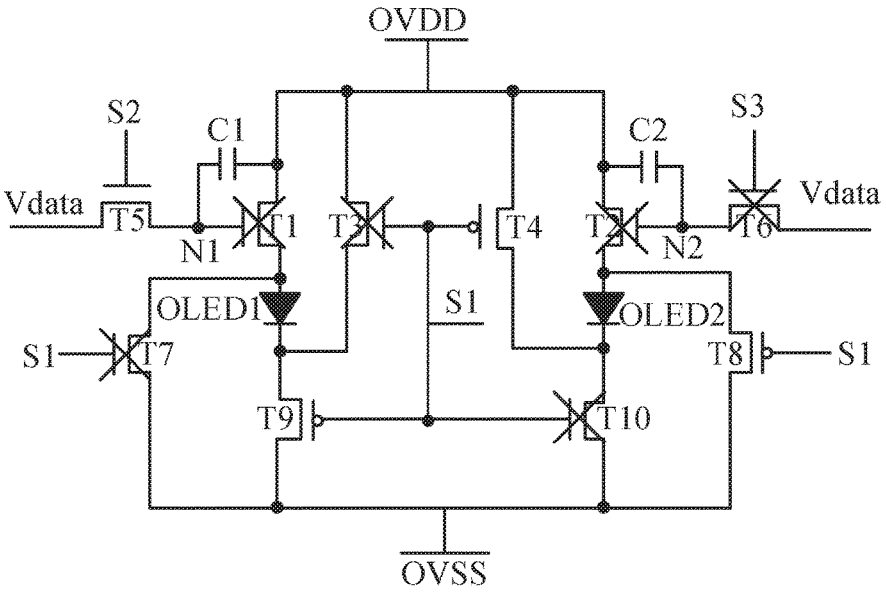
FIG. 4 is a schematic diagram showing step 2 of a method for retarding the aging of an OLED device according to the present disclosure.
Figure 7:
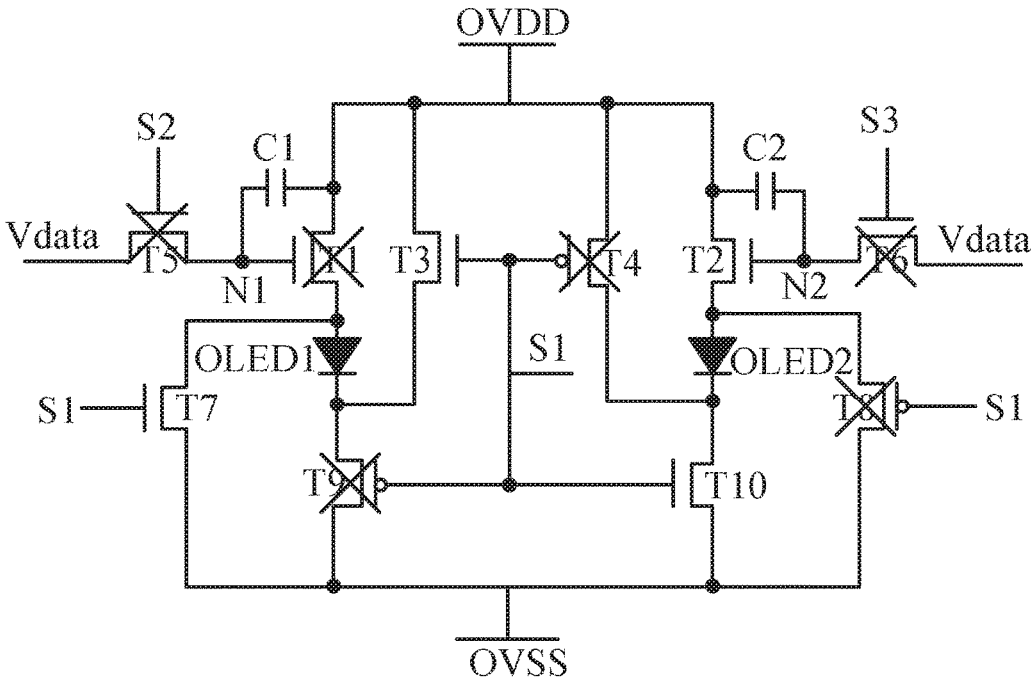
FIG. 7 is a schematic diagram showing step 5 of the method for retarding the aging of an OLED device according to the present disclosure.

Referring to FIGS. 4 and 7 and in combination with FIGS. 2 and 3, the working process of the OLED pixel circuit of the present disclosure is as follows.

Referring to FIGS. 3 and 4, in the potential storage stage t1 of the first light emitting diode, since the first control signal S1 provides a low potential, the second control signal S2 provides a high potential and the third control signal S3 provides a low potential, the fourth thin-film transistor T4, the fifth thin-film transistor T5, the eighth thin-film transistor T8, and the ninth thin-film transistor T9 are controlled to be turned on, and the first thin-film transistor T1, the second thin-film transistor T2, the third thin-film transistor T3, the sixth thin-film transistor T6, the seventh thin-film transistor T7, and the tenth thin-film transistor T10 are controlled to be turned off, a potential of the data signal Vdata is stored by the first capacitor C1, and the second light emitting diode OLED2 is brought into a reversely biased state. That is, an anode terminal of the second light emitting diode OLED2 is connected to the negative supply voltage OVSS, while a cathode terminal thereof is connected to the positive supply voltage OVDD.

Figure 5:
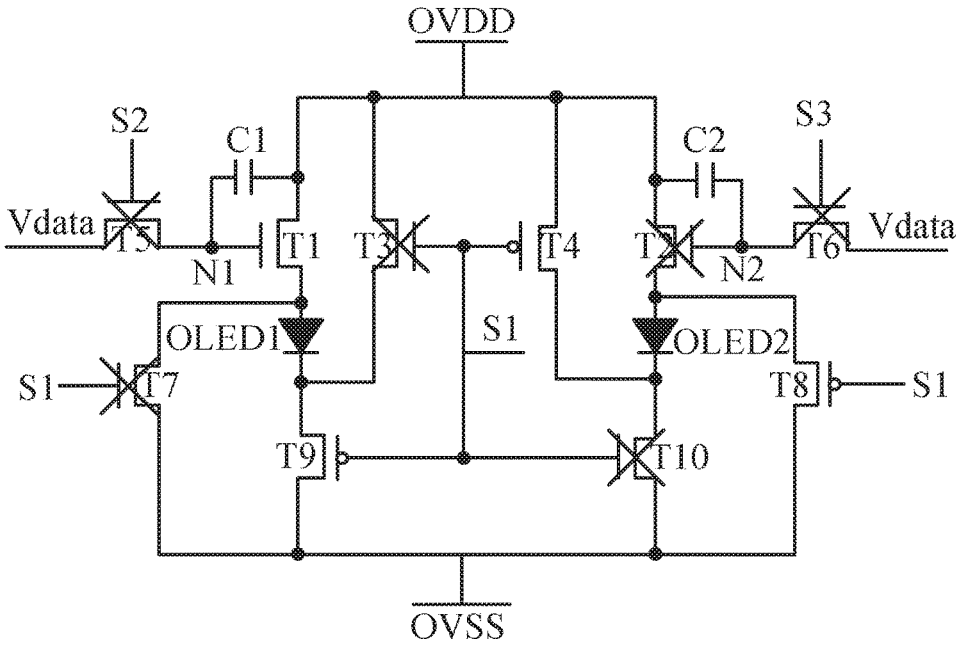
FIG. 5 is a schematic diagram showing step 3 of the method for retarding the aging of an OLED device according to the present disclosure.

Referring to FIGS. 3 and 5, in the luminescent display stage t2 of the first light emitting diode, since the first control signal S1 provides a low potential, the second control signal S2 provides a low potential and the third control signal S3 provides a low potential, the first thin-film transistor T1, the fourth thin-film transistor T4, the eighth thin-film transistor T8, and the ninth thin-film transistor T9 are controlled to be turned on, the second thin-film transistor T2, the third thin-film transistor T3, the fifth thin-film transistor T5, the sixth thin-film transistor T6, the seventh thin-film transistor T7, and the tenth thin-film transistor T10 are controlled to be turned off, the first light emitting diode OLED1 emits light, and the second light emitting diode OLED2 is kept in the reversely biased state.

Figure 6:
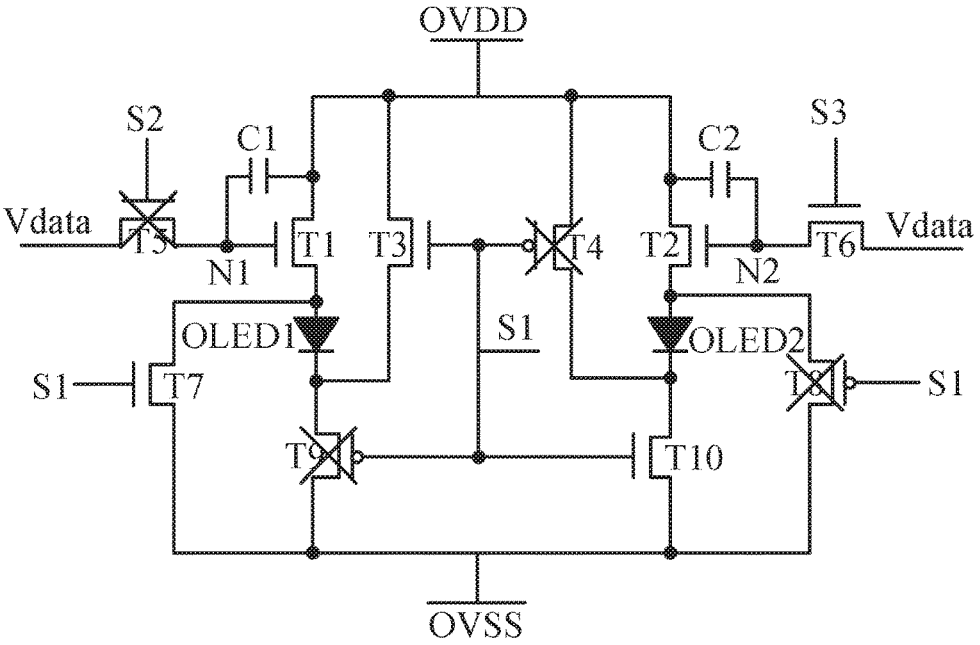
FIG. 6 is a schematic diagram showing step 4 of the method for retarding the aging of an OLED device according to the present disclosure.

Referring to FIGS. 3 and 6, in the potential storage stage t3 of the second light emitting diode, since the first control signal S1 provides a high potential, the second control signal S2 provides a low potential and the third control signal S3 provides a high potential, the first thin-film transistor T1, the second thin-film transistor T2, the third thin-film transistor T3, the sixth thin-film transistor T6, the seventh thin-film transistor T7, and the ninth thin-film transistor T9 are controlled to be turned on, and the fourth thin-film transistor T4, the fifth thin-film transistor T5, the eighth thin-film transistor T8, and the tenth thin-film transistor T10 are controlled to be turned off, a potential of the data signal Vdata is stored by the second capacitor C2, and the first light emitting diode OLED1 is brought into a reversely biased state. That is, an anode terminal of the first light emitting diode OLED1 is connected to the negative supply voltage OVSS, while a cathode terminal thereof is connected to the positive supply voltage OVDD.

Referring to FIGS. 3 and 7, in the luminescent display stage t4 of the second light emitting diode, since the first control signal S1 provides a high potential, the second control signal S2 provides a low potential and the third control signal S3 provides a low potential, the second thin-film transistor T2, the third thin-film transistor T3, the seventh thin-film transistor T7, and the tenth thin-film transistor T10 are controlled to be turned on, and the first thin-film transistor T1, the fourth thin-film transistor T4, the fifth thin-film transistor T5, the sixth thin-film transistor T6, the eighth thin-film transistor T8, and the ninth thin-film transistor T9 are controlled to be turned off, the second light emitting diode OLED2 emits light, and the first light emitting diode OLED1 is kept in the reversely biased state.

In the OLED pixel circuit of the present disclosure, by providing a first sub-pixel driving unit, a second sub-pixel driving unit, a first reverse biasing unit, and a second reverse biasing unit and by simple control timing, a first light emitting diode and a second light emitting diode will not always be in a DC biased state, and the first light emitting diode and the second light emitting diode will emit light alternately in different frames. Accordingly, the luminescence time of the first light emitting diode and the second light emitting diode is reduced, the aging of the first light emitting diode and the second light emitting diode is retarded, and the display quality of a panel is improved.

Referring to FIGS. 4 to 7 and in combination with FIGS. 2 and 3, based on the foregoing OLED pixel circuit, the present disclosure further provides a method for retarding the aging of an OLED device that includes the following steps:

step 1: providing an OLED pixel circuit;

wherein the OLED pixel circuit includes:

a first sub-pixel driving unit 101 including a first thin-film transistor T1, a fifth thin-film transistor T5, a first capacitor C1, and a first light emitting diode OLED1;

a second sub-pixel driving unit 102 including a second thin-film transistor T2, a sixth thin-film transistor T6, a second capacitor C2, and a second light emitting diode OLED2; wherein both a source of the first thin-film transistor T1 and a source of the second thin-film transistor T2 are connected to a positive supply voltage OVDD; a gate of the first thin-film transistor T1 is electrically connected to a first node N1, and a gate of the second thin-film transistor T2 is electrically connected to a second node N2; and, a drain of the first thin-film transistor T1 is electrically connected to an anode of the first light emitting diode OLED1, and a drain of the second thin-film transistor T2 is electrically connected to an anode of the second light emitting diode OLED2;

a data signal Vdata is fed into both a source of the fifth thin-film transistor T5 and a source of the sixth thin-film transistor T6; a drain of the fifth thin-film transistor T5 is electrically connected to the first node N1, and a drain of the sixth thin-film transistor T6 is electrically connected to the second node N2; and, a second control signal S2 is fed into a gate of the fifth thin-film transistor T5, and a third control signal S3 is fed into a gate of the sixth thin-film transistor T6;

one end of the first capacitor C1 is electrically connected to the first node N1, while the other end thereof is connected to the positive supply voltage OVDD; and, one end of the second capacitor C2 is electrically connected to the second node N2, while the other end thereof is connected to the positive supply voltage OVDD;

a first reverse biasing unit 103 including a third thin-film transistor T3, a seventh thin-film transistor T7, and a ninth thin-film transistor T9;

a second reverse biasing unit 14 includes a fourth thin-film transistor T4, an eighth thin-film transistor T8, and a tenth thin-film transistor T10; wherein a first control signal S1 is fed into both a gate of the third thin-film transistor T3 and a gate of the fourth thin-film transistor T4; both a source of the third thin-film transistor T3 and a source of the fourth thin-film transistor T4 are connected to the positive supply voltage OVDD; and, a drain of the third thin-film transistor T3 is electrically connected to a cathode of the first light emitting diode OLED1, and a drain of the fourth thin-film transistor T4 is electrically connected to the cathode of the second light emitting diode OLED2;

the first control signal S1 is fed into both a gate of the seventh thin-film transistor T7 and a gate of the eighth thin-film transistor T8; a drain of the seventh thin-film transistor T7 is electrically connected to an anode terminal of the first light emitting diode OLED1, and a drain of the eighth thin-film transistor T8 is electrically connected to an anode terminal of the second light emitting diode OLED2; and, both a source of the seventh thin-film transistor T7 and a source of the eighth thin-film transistor T8 are connected to a negative supply voltage OVSS;

the first control signal S1 is fed into both a gate of the ninth thin-film transistor T9 and a gate of the tenth thin-film transistor T10; both a source of the ninth thin-film transistor T9 and a source of the tenth thin-film transistor T10 are connected to the negative supply voltage OVSS; and, a drain of the ninth thin-film transistor T9 is electrically connected to the cathode of the first light emitting diode OLED1, and a drain of the tenth thin-film transistor T10 is electrically connected to the cathode of the second light emitting diode OLED2;

step 2: entering the potential storage stage t1 of the first light emitting diode;

controlling, by the first control signal S1, the second control signal S2 and the third control signal S3, to turn on the fourth thin-film transistor T4, the fifth thin-film transistor T5, the eighth thin-film transistor T8, and the ninth thin-film transistor T9 and to turn off the first thin-film transistor T1, the second thin-film transistor T2, the third thin-film transistor T3, the sixth thin-film transistor T6, the seventh thin-film transistor T7, and the tenth thin-film transistor T10, storing a potential of the data signal Vdata by the first capacitor C1, and bringing the second light emitting diode OLED2 into a reversely biased state;

step 3: entering the luminescent display stage t2 of the first light emitting diode;

controlling, by the first control signal S1, the second control signal S2, and the third control signal S3, to turn on the first thin-film transistor T1, the fourth thin-film transistor T4, the eighth thin-film transistor T8, and the ninth thin-film transistor T9 and to turn off the second thin-film transistor T2, the third thin-film transistor T3, the fifth thin-film transistor T5, the sixth thin-film transistor T6, the seventh thin-film transistor T7, and the tenth thin-film transistor T10, emitting light by the first light emitting diode OLED1, and keeping the second light emitting diode OLED2 in the reversely biased state;

step 4: entering the potential storage stage t3 of the second light emitting diode;

controlling, by the first control signal S1, the second control signal S2 and the third control signal S3, to turn on the first thin-film transistor T1, the second thin-film transistor T2, the third thin-film transistor T3, the sixth thin-film transistor T6, the seventh thin-film transistor T7, and the ninth thin-film transistor T9 and to turn off the fourth thin-film transistor T4, the fifth thin-film transistor T5, the eighth thin-film transistor T8, and the tenth thin-film transistor T10, storing a potential of the data signal Vdata by the second capacitor C2, and bringing the first light emitting diode OLED1 into the reversely biased state; and step 5: entering the luminescent display stage t4 of the second light emitting diode;

controlling, by the first control signal S1, the second control signal S2 and the third control signal S3, to turn on the second thin-film transistor T2, the third thin-film transistor T3, the seventh thin-film transistor T7, and the tenth thin-film transistor T10 and to turn off the first thin-film transistor T1, the fourth thin-film transistor T4, the fifth thin-film transistor T5, the sixth thin-film transistor T6, the eighth thin-film transistor T8, and the ninth thin-film transistor T9, emitting light by the second light emitting diode OLED2, and keeping the first light emitting diode OLED1 in the reversely biased state.

Preferably, the first control signal S1, the second control signal S2, and the third control signal S3 are all provided by an external timing controller.

Preferably, the first thin-film transistor T1, the second thin-film transistor T2, the third thin-film transistor T3, the fourth thin-film transistor T4, the fifth thin-film transistor T5, the sixth thin-film transistor T6, the seventh thin-film transistor T7, the eighth thin-film transistor T8, the ninth thin-film transistor T9, and the tenth thin-film transistor T10 are all low temperature polysilicon thin-film transistors, oxide semiconductor thin-film transistors or amorphous silicon thin-film transistors Preferably, the first thin-film transistor T1, the second thin-film transistor T2, the third thin-film transistor T3, the fifth thin-film transistor T5, the sixth thin-film transistor T6, the seventh thin-film transistor T7, and the tenth thin-film transistor T10 are all N-type thin-film transistors; the fourth thin-film transistor T4, the eighth thin-film transistor T8, and the ninth thin-film transistor T9 are all P-type thin-film transistors.

in the potential storage stage t1 of the first light emitting diode, the first control signal S1 provides a low potential, the second control signal S2 provides a high potential, and the third control signal S3 provides a low potential;

in the luminescent display stage t2 of the first light emitting diode, the first control signal S1 provides a low potential, the second control signal S2 provides a low potential, and the third control signal S3 provides a low potential;

in the potential storage stage t3 of the second light emitting diode, the first control signal S1 provides a high potential, the second control signal S2 provides a low potential, and the third control signal S3 provides a high potential; and in the luminescent display stage t4 of the second light emitting diode, the first control signal S1 provides a high potential, the second control signal S2 provides a low potential, and the third control signal S3 provides a low potential.

In the OLED pixel circuit and the method for retarding the aging of an OLED device of the present disclosure, by providing a first sub-pixel driving unit, a second sub-pixel driving unit, a first reverse biasing unit, and a second reverse biasing unit and by simple control timing, a first light emitting diode and a second light emitting diode will not always be in a DC biased state, and the first light emitting diode and the second light emitting diode will emit light alternately in different frames. Accordingly, the luminescence time of the first light emitting diode and the second light emitting diode is reduced, the aging of the first light emitting diode and the second light emitting diode is retarded, and the display quality of a panel is improved.

In conclusion, although the present disclosure has been described with reference to the preferred embodiment thereof, it is apparent to those skilled in the art that a variety of modifications and changes may be made without departing from the scope of the present disclosure which is intended to be defined by the appended claims.

What is claimed is:

1. An OLED pixel circuit, comprising:

a first sub-pixel driving unit, comprising a first thin-film transistor, a fifth thin-film transistor, a first capacitor, and a first light emitting diode;

a second sub-pixel driving unit, comprising a second thin-film transistor, a sixth thin-film transistor, a second capacitor, and a second light emitting diode, wherein:

both a source of the first thin-film transistor and a source of the second thin-film transistor are connected to a positive supply voltage; a gate of the first thin-film transistor is electrically connected to a first node, and a gate of the second thin-film transistor is electrically connected to a second node; and, a drain of the first thin-film transistor is electrically connected to an anode of the first light emitting diode, and a drain of the second thin-film transistor is electrically connected to an anode of the second light emitting diode;

a data signal is fed into both a source of the fifth thin-film transistor and a source of the sixth thin-film transistor; a drain of the fifth thin-film transistor is electrically connected to the first node, and a drain of the sixth thin-film transistor is electrically connected to the second node; and, a second control signal is fed into a gate of the fifth thin-film transistor, and a third control signal is fed into a gate of the sixth thin-film transistor; and one end of the first capacitor is electrically connected to the first node, while the other end thereof is connected to the positive supply voltage; and, one end of the second capacitor is electrically connected to the second node, while the other end thereof is connected to the positive supply voltage;

a first reverse biasing unit, comprising a third thin-film transistor, a seventh thin-film transistor, and a ninth thin-film transistor; and a second reverse biasing unit, comprising a fourth thin-film transistor, an eighth thin-film transistor, and a tenth thin-film transistor, wherein:

a first control signal is fed into both a gate of the third thin-film transistor and a gate of the fourth thin-film transistor; both a source of the third thin-film transistor and a source of the fourth thin-film transistor are connected to the positive supply voltage; and, a drain of the third thin-film transistor is electrically connected to a cathode of the first light emitting diode, and a drain of the fourth thin-film transistor is electrically connected to a cathode of the second light emitting diode;

the first control signal is fed into both a gate of the seventh thin-film transistor and a gate of the eighth thin-film transistor; a drain of the seventh thin-film transistor is electrically connected to an anode terminal of the first light emitting diode, and a drain of the eighth thin-film transistor is electrically connected to an anode terminal of the second light emitting diode; and, both a source of the seventh thin-film transistor and a source of the eighth thin-film transistor are connected to a negative supply voltage;

the first control signal is fed into both a gate of the ninth thin-film transistor and a gate of the tenth thin-film transistor; both a source of the ninth thin-film transistor and a source of the tenth thin-film transistor are connected to the negative supply voltage; and, a drain of the ninth thin-film transistor is electrically connected to the cathode of the first light emitting diode, and a drain of the tenth thin-film transistor is electrically connected to the cathode of the second light emitting diode;

the first control signal, the second control signal, and the third control signal are all provided by an external timing controller;

the first thin-film transistor, the second thin-film transistor, the third thin-film transistor, the fourth thin-film transistor, the fifth thin-film transistor, the sixth thin-film transistor, the seventh thin-film transistor, the eighth thin-film transistor, the ninth thin-film transistor, and the tenth thin-film transistor are all low temperature polysilicon thin-film transistors, oxide semiconductor thin-film transistors or amorphous silicon thin-film transistors; wherein the first thin-film transistor, the second thin-film transistor, the third thin-film transistor, the fifth thin-film transistor, the sixth thin-film transistor, the seventh thin-film transistor, and the tenth thin-film transistor are all N-type thin-film transistors; the fourth thin-film transistor, the eighth thin-film transistor, and the ninth thin-film transistor are all P-type thin-film transistors;

in the potential storage stage of the first light emitting diode, the first control signal provides a low potential, the second control signal provides a high potential, and the third control signal provides a low potential;

in the luminescent display stage of the first light emitting diode, the first control signal provides a low potential, the second control signal provides a low potential, and the third control signal provides a low potential;

in the potential storage stage of the second light emitting diode, the first control signal provides a high potential, the second control signal provides a low potential, and the third control signal provides a high potential; and in the luminescent display stage of the second light emitting diode, the first control signal provides a high potential, the second control signal provides a low potential, and the third control signal provides a low potential.

2. The OLED pixel circuit as claimed in claim 1, wherein the first control signal, the second control signal, and the third control signal are combined to sequentially correspond to a potential storage stage of the first light emitting diode, a luminescent display stage of the first light emitting diode, a potential storage stage of the second light emitting diode and a luminescent display stage of the second light emitting diode.

3. A method for retarding aging of an OLED device, comprising the following steps:

step 1: providing the OLED pixel circuit according to claim 1;

step 2: entering a potential storage stage of the first light emitting diode, the potential storage stage of the first light emitting diode being in an Nth frame;

controlling, by the first control signal, the second control signal, and the third control signal, to turn on the fourth thin-film transistor, the fifth thin-film transistor, the eighth thin-film transistor, and the ninth thin-film transistor and to turn off the first thin-film transistor, the second thin-film transistor, the third thin-film transistor, the sixth thin-film transistor, the seventh thin-film transistor, and the tenth thin-film transistor, storing a potential of a data signal by the first capacitor, and bringing the second light emitting diode into a reversely biased state;

step 3: entering a luminescent display stage of the first light emitting diode, the luminescent display stage of the first light emitting diode being in an Nth frame;

controlling, by the first control signal, the second control signal, and the third control signal, to turn on the first thin-film transistor, the fourth thin-film transistor, the eighth thin-film transistor, and the ninth thin-film transistor and to turn off the second thin-film transistor, the third thin-film transistor, the fifth thin-film transistor, the sixth thin-film transistor, the seventh thin-film transistor, and the tenth thin-film transistor, emitting light by the first light emitting diode, and keeping the second light emitting diode in the reversely biased state;

step 4: entering a potential storage stage of the second light emitting diode, the potential storage stage of the second light emitting diode being in an (N+1)th frame;

controlling, by the first control signal, the second control signal, and the third control signal, to turn on the first thin-film transistor, the second thin-film transistor, the third thin-film transistor, the sixth thin-film transistor, the seventh thin-film transistor, and the ninth thin-film transistor and to turn off the fourth thin-film transistor, the fifth thin-film transistor, the eighth thin-film transistor, and the tenth thin-film transistor, storing a potential of a data signal by the second capacitor, and bringing the first light emitting diode into the reversely biased state; and step 5: entering a luminescent display stage of the second light emitting diode, the luminescent display stage of the second light emitting diode being in an (N+1)th frame;

controlling, by the first control signal, the second control signal, and the third control signal, to turn on the second thin-film transistor, the third thin-film transistor, the seventh thin-film transistor, and the tenth thin-film transistor and to turn off the first thin-film transistor, the fourth thin-film transistor, the fifth thin-film transistor, the sixth thin-film transistor, the eighth thin-film transistor, and the ninth thin-film transistor, emitting light by the second light emitting diode, and keeping the first light emitting diode in the reversely biased state; wherein the first thin-film transistor, the second thin-film transistor, the third thin-film transistor, the fifth thin-film transistor, the sixth thin-film transistor, the seventh thin-film transistor, and the tenth thin-film transistor are all N-type thin-film transistors; the fourth thin-film transistor, the eighth thin-film transistor, and the ninth thin-film transistor are all P-type thin-film transistors;

in the potential storage stage of the first light emitting diode, the first control signal provides a low potential, the second control signal provides a high potential, and the third control signal provides a low potential;

in the luminescent display stage of the first light emitting diode, the first control signal provides a low potential, the second control signal provides a low potential, and the third control signal provides a low potential;

in the potential storage stage of the second light emitting diode, the first control signal provides a high potential, the second control signal provides a low potential, and the third control signal provides a high potential; and in the luminescent display stage of the second light emitting diode, the first control signal provides a high potential, the second control signal provides a low potential, and the third control signal provides a low potential.

4. The method for retarding aging of an OLED device as claimed in claim 3, wherein the first control signal, the second control signal, and the third control signal are all provided by an external timing controller.

5. The method for retarding aging of an OLED device as claimed in claim 3, wherein the first thin-film transistor, the second thin-film transistor, the third thin-film transistor, the fourth thin-film transistor, the fifth thin-film transistor, the sixth thin-film transistor, the seventh thin-film transistor, the eighth thin-film transistor, the ninth thin-film transistor, and the tenth thin-film transistor are all low temperature polysilicon thin-film transistors, oxide semiconductor thin-film transistors or amorphous silicon thin-film transistors.

6. An OLED pixel circuit, comprising:

a first sub-pixel driving unit, comprising a first thin-film transistor, a fifth thin-film transistor, a first capacitor, and a first light emitting diode;

a second sub-pixel driving unit, comprising a second thin-film transistor, a sixth thin-film transistor, a second capacitor, and a second light emitting diode, wherein:

both a source of the first thin-film transistor and a source of the second thin-film transistor are connected to a positive supply voltage; a gate of the first thin-film transistor is electrically connected to a first node, and a gate of the second thin-film transistor is electrically connected to a second node; and, a drain of the first thin-film transistor is electrically connected to an anode of the first light emitting diode, and a drain of the second thin-film transistor is electrically connected to an anode of the second light emitting diode;

a data signal is fed into both a source of the fifth thin-film transistor and a source of the sixth thin-film transistor; a drain of the fifth thin-film transistor is electrically connected to the first node, and a drain of the sixth thin-film transistor is electrically connected to the second node; and, a second control signal is fed into a gate of the fifth thin-film transistor, and a third control signal is fed into a gate of the sixth thin-film transistor; and one end of the first capacitor is electrically connected to the first node, while the other end thereof is connected to the positive supply voltage; and, one end of the second capacitor is electrically connected to the second node, while the other end thereof is connected to the positive supply voltage;

a first reverse biasing unit, comprising a third thin-film transistor, a seventh thin-film transistor, and a ninth thin-film transistor; and a second reverse biasing unit, comprising a fourth thin-film transistor, an eighth thin-film transistor, and a tenth thin-film transistor, wherein:

a first control signal is fed into both a gate of the third thin-film transistor and a gate of the fourth thin-film transistor; both a source of the third thin-film transistor and a source of the fourth thin-film transistor are connected to the positive supply voltage; and, a drain of the third thin-film transistor is electrically connected to a cathode of the first light emitting diode, and a drain of the fourth thin-film transistor is electrically connected to a cathode of the second light emitting diode;

the first control signal is fed into both a gate of the seventh thin-film transistor and a gate of the eighth thin-film transistor; a drain of the seventh thin-film transistor is electrically connected to an anode terminal of the first light emitting diode, and a drain of the eighth thin-film transistor is electrically connected to an anode terminal of the second light emitting diode; and, both a source of the seventh thin-film transistor and a source of the eighth thin-film transistor are connected to a negative supply voltage;

the first control signal is fed into both a gate of the ninth thin-film transistor and a gate of the tenth thin-film transistor; both a source of the ninth thin-film transistor and a source of the tenth thin-film transistor are connected to the negative supply voltage; and, a drain of the ninth thin-film transistor is electrically connected to the cathode of the first light emitting diode, and a drain of the tenth thin-film transistor is electrically connected to the cathode of the second light emitting diode; wherein the first thin-film transistor, the second thin-film transistor, the third thin-film transistor, the fifth thin-film transistor, the sixth thin-film transistor, the seventh thin-film transistor, and the tenth thin-film transistor are all N-type thin-film transistors; the fourth thin-film transistor, the eighth thin-film transistor, and the ninth thin-film transistor are all P-type thin-film transistors;

in the potential storage stage of the first light emitting diode, the first control signal provides a low potential, the second control signal provides a high potential, and the third control signal provides a low potential;

in the luminescent display stage of the first light emitting diode, the first control signal provides a low potential, the second control signal provides a low potential, and the third control signal provides a low potential;

in the potential storage stage of the second light emitting diode, the first control signal provides a high potential, the second control signal provides a low potential, and the third control signal provides a high potential; and in the luminescent display stage of the second light emitting diode, the first control signal provides a high potential, the second control signal provides a low potential, and the third control signal provides a low potential.

7. The OLED pixel circuit as claimed in claim 6, wherein the first control signal, the second control signal, and the third control signal are all provided by an external timing controller.

8. The OLED pixel circuit as claimed in claim 6, wherein the first thin-film transistor, the second thin-film transistor, the third thin-film transistor, the fourth thin-film transistor, the fifth thin-film transistor, the sixth thin-film transistor, the seventh thin-film transistor, the eighth thin-film transistor, the ninth thin-film transistor, and the tenth thin-film transistor are all low temperature polysilicon thin-film transistors, oxide semiconductor thin-film transistors or amorphous silicon thin-film transistors.

9. The OLED pixel circuit as claimed in claim 6, wherein the first control signal, the second control signal, and the third control signal are combined to sequentially correspond to a potential storage stage of the first light emitting diode, a luminescent display stage of the first light emitting diode, a potential storage stage of the second light emitting diode and a luminescent display stage of the second light emitting diode.

* * * * *